US005545034A

United States Patent [19]

Le Monnier De Gouville

[11] Patent Number: 5,545,034

[45] Date of Patent: Aug. 13, 1996

[54] ELECTRICAL HARNESS FOR WIRING THE ELECTRICAL IGNITION CIRCUIT OF A COOKING APPLIANCE WITH GAS BURNERS

[75] Inventor: Jean-Bernard Le Monnier De Gouville, Joue les Tours, France

[73] Assignee: Sourdillon, Veigne, France

[21] Appl. No.: 318,995

[22] Filed: Oct. 6, 1994

[30] Foreign Application Priority Data

Oct. 7, 1993 [FR] France ..... 93 11960

[51] Int. Cl.[6] ..... F23Q 7/12

[52] U.S. Cl. ..... 431/255; 431/256

[58] Field of Search ..... 431/264, 256, 431/255; 361/263

[56] References Cited

U.S. PATENT DOCUMENTS 2,146,660 2/1939 Swartz ..... 431/256
4,222,089 9/1980 MacAskill, Jr. et al. .

FOREIGN PATENT DOCUMENTS 1380556 1/1975 United Kingdom .

*Primary Examiner*—Carroll B. Dority
*Attorney, Agent, or Firm*—Larson and Taylor

[57] ABSTRACT

An electrical harness for wiring the electrical ignition circuit of a cooking appliance equipped with a plurality of gas burners each provided with a remote-controlled electrical ignition element, comprising: a low-voltage electrical power supply line (1), one of the ends of which is provided with respective terminals (2) for its electrical connection to a low-voltage electrical power supply; a plurality of high-voltage generating units (3), the number thereof being equal to the number of gas burners (10), and being electrically connected to the said power supply line, each unit (3) comprising a switch (4) to control the power supply and being provided with means (5) for fast mechanical connection for connecting the same to the respective gas tap body; mechanical connecting means (6) for mechanically connecting each of the high-voltage generating units (3) to the electrical power supply line (1); and respective high-voltage output lines (7) from the high-voltage generating units (3), the free ends of said lines being provided with a terminal (8) for connection to the respective ignition element.

6 Claims, 2 Drawing Sheets

ELECTRICAL HARNESS FOR WIRING THE ELECTRICAL IGNITION CIRCUIT OF A COOKING APPLIANCE WITH GAS BURNERS

This invention relates to improvements to cooking appliances provided with gas burners and, more particularly, relates to improvements to the wiring of the electrical ignition circuit of a cooking appliance equipped with a plurality of gas burners each provided with a remote-controlled electrical ignition element.

The electrical ignition circuit of gas burners was hitherto installed by individually fitting the components and the wires during the manufacture of the cooking appliance. However, this conventional assembly process is unsuitable for economic manufacture. Assembly component by component is a long process; wiring an ignition circuit with simultaneous control of all the igniters is complicated and requires a high-voltage transformer unit dimension for the exact number of igniters to be controlled, and hence this complicates supply and stock-keeping; moreover, the wiring of an ignition circuit with individual control of the igniters is even more complicated and, therefore, little used. In every case, the fitting of the circuit is accompanied by making numerous connections in situ and hence under conditions such that the reliability of the circuit is greatly reduced and the number of electrical breakdowns is high right from the start of the operation of the appliance.

The main object of the invention therefore is to obviate the above disadvantages and propose a solution which is adapted not only to simplify the step of wiring the ignition circuit of the burners of the cooking appliance but also, because of such simplification, allows standardisation of the fitting of an individual ignition circuit to the burners and generally leads to reduced costs with increased reliability.

For these purposes, the invention proposes prefabricating in a specialised workshop an electrical harness for wiring the electrical ignition circuit of a cooking appliance equipped with a plurality of gas burners each provided with a remote-controlled electrical ignition element, such harness arranged according to the invention being essentially characterised in that it comprises:

- a low-voltage electrical power supply line, one the ends of which is provided with respective terminals for its electrical connection to a low-voltage electrical power supply,
- a plurality of high-voltage generating units, the number thereof being equal to the number of gas burners, and being electrically connected to the said power supply line, each unit comprising a switch to control the power supply and being provided with means for fast mechanical connection for connecting the same to a gas tap body controlling the supply of gas to the respective burner,
- mechanical connecting means for mechanically connecting each of the high-voltage generating units to the electrical power supply line,
- and respective high-voltage output lines from the high-voltage generating units, the free ends of said lines being provided with a terminal for connection to the respective ignition element.

Very advantageously, it also comprises gas taps mechanically connected, more-particularly by snap action, to the respective high-voltage generator units.

Pre-wiring the harness in a specialised workshop enables this work to be carried out with every attention and all the technical expertise required, which the manufacturers of cooking appliances could not hitherto readily combine in their own assembly workshops.

Also, the arrangement used to form the harness results in a modular structure which allows easy and rapid adaptation to diverse configurations of cooking appliances (i.e. in respect of number of burners, burner layout on the top plate, location and mutual spacing of gas taps, and so on).

Also, the modular series structure of the said harness enables individual control of the burner ignition to be embodied more simply and more cheaply than previously.

Finally, each module has as its function to ignite only one burner and all the modules can be made identical: only one type of high-voltage transformer is required and, being of reduced power, is cheaper and smaller. To this we may add the advantage of the choice of the finish for the modules, which may either include just the high-voltage generator unit or combine the latter and the gas tap interconnected to one another.

Finally, and by no means least, the structure adopted for the harness greatly reduces the number of connections with respect to conventional wiring; this not only results in simplification of its manufacture but, in particular, the number of breakdowns due to the electrical circuit of the cooking appliances sold is considerably reduced.

Advantageously, the gas taps are mechanically connected to the respective high-voltage generator units in such manner that the switch is controlled so as to be closed by an axial actuation of the shaft of the gas tap.

Preferably, for appreciable simplification of production of the harness, the means for fast mechanical connection of each high-voltage generator unit to the power supply line are adapted simultaneously to form the electrical connection means between said unit and said line, more particularly when the means for electrically connecting each high-voltage generator unit to the power supply line are adapted automatically to perforate an insulating sheath or sheaths protecting the line.

The invention will be more readily understood from the following detailed description of specific embodiments given solely by way of example without any limiting force. This description is given with reference to the accompanying drawings wherein.

Figure 1:
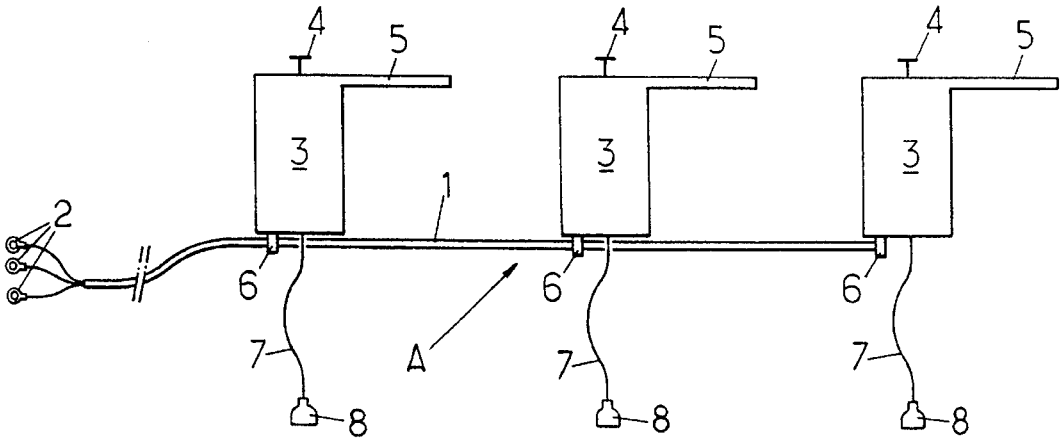
FIG. 1 is a highly diagrammatic representation of a pro-wired electrical harness according to the invention.

Referring to FIG. 1, a simple version of an electrical harness A is shown very diagrammatically, such harness being arranged according to the invention for wiring the electrical ignition circuit of a cooking appliance (a domestic appliance such as a cooker, or hob) provided with a number of gas burners each provided with a remote-controlled electrical ignition means. Said harness comprises:

- a low-voltage electrical supply line 1, one of the ends of which (the free end) is provided with respective terminals 2 for its electrical connection to a low-voltage electricity power supply; in practice this will be the mains power supply (e.g. 220 V AC 50 Hz) and the line 1 is a three-wire line (two phase wires and one earth line );
- a number of high-voltage generator units 3, the number of these being equal to the number of gas burners (three in FIG. 1); each unit 3 comprises a high-voltage transformer with a primary winding connected electrically to the said power line 1; since each unit is intended only for controlling a single ignition element, the transformer is a low-power transformer of restricted size and occupying little space, its cost being reduced; each unit 3 is also provided with a power supply switch 4 for the primary winding of the corresponding high-voltage transformer, one example of the connection of the switch being given hereinafter; finally, each unit 3 is provided with means 5 for quick mechanical connection (e.g. by snap action) to connect it to a gas tap body controlling the gas supply to the respective burner;

mechanical connecting means 6 for mechanically connecting each of the units 3 to the power supply line 1; and respective high-voltage output lines 7 from the units 3, their free ends being provided with a terminal 8 for connection to the respective ignition element.

To simplify and accelerate the production of the harness, the means 6 for mechanically connecting each high-voltage generator unit 3 to the power line 1 are of the rapid fitting type and are so arranged as simultaneously to form the means for electrically of the rapid fitting type and are so arranged as connecting each unit 3 to the said line 1; for this purpose, the means for electrically connecting each high-voltage generator 3 to the line 1 are adapted automatically to perforate an insulating sheath or sheaths protecting the line 1. In this way, the power supply line 1 remains unitary and without any gap, i.e. it extends continuously from the terminals 2 to the last unit 3 without any intermediate connections, and this is so irrespective of the number of units used. Numerous embodiments of such mechanical and electrical connection means are known to the skilled man.

Figure 2:
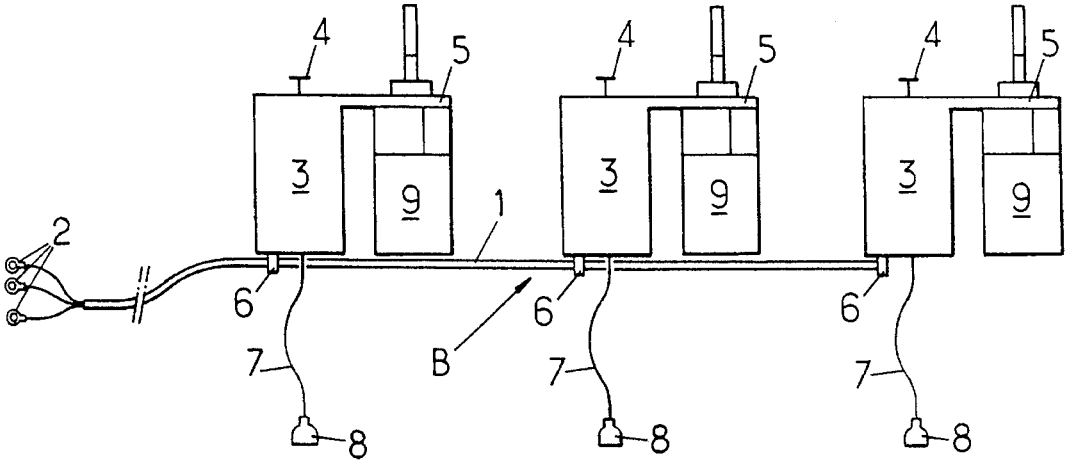
FIG. 2 is a highly diagrammatic representation of a pro-wired electrical harnesses according to one preferred embodiment of the invention.

FIG. 2 is a highly diagrammatic illustration of one preferred embodiment of a wiring harness B arranged according to the invention and comprising all the above-mentioned features for the simple harness A of FIG. 1, but which also comprises gas taps 9 connected mechanically, more particularly by snap action, to the respective high-voltage units 3 by the rapid mechanical connecting means 5 with which said units are provided. Again in order to increase reliability and for simplification purposes, the gas taps 9 are mechanically connected to the respective high-voltage generator units 3 in such manner that each switch is so controlled as to close by axial actuation of the shaft of the tap controlling the supply of gas to the corresponding burner.

Figure 3:
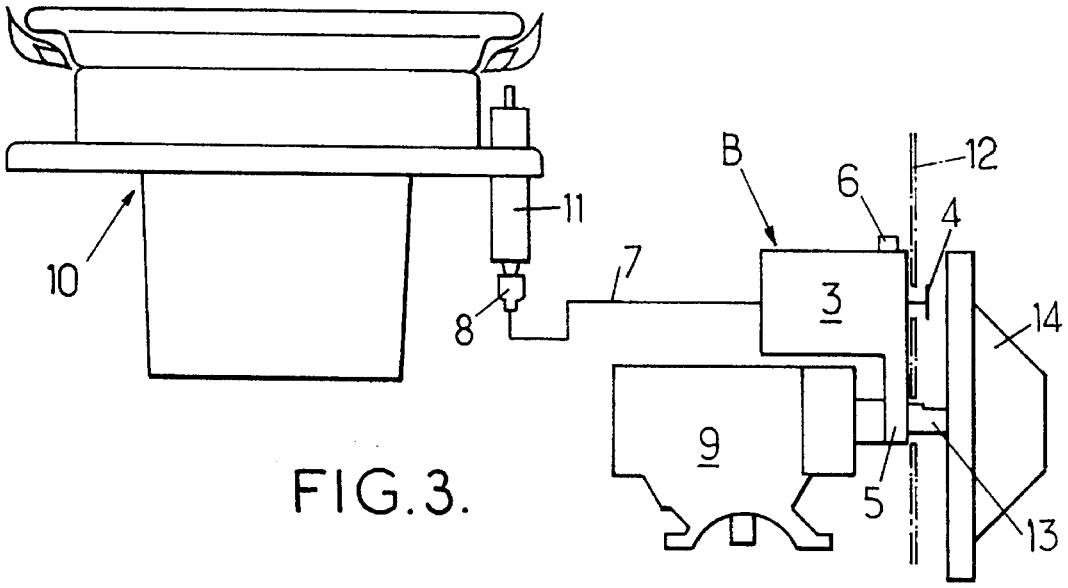
FIG. 3 is a diagrammatic representation showing a gas burner associated with an ignition circuit comprising the harness shown in FIG. 2.

FIG. 3, in which the same numerical references are used to denote the components already shown in FIGS. 1 and 2, diagrammatically illustrates a gas burner having the general reference 10. The burner is equipped with an electrical ignition element 11, to the bottom of which is secured the connection 8 of the corresponding high-voltage line 7 from the respective high-voltage unit 3 of the harness B (this module is visible only in FIG. 3). The gas tap 9—mechanically connected to the high-voltage unit 3—is conventionally fixed on the front panel 12 of the cooker. The projecting end of the shaft 13 is provided with an actuating knob 14, behind which is disposed the switch 4, the actuating head of which extends freely through the front panel 12.

To operate the burner 10, the knob 14 must first be pushed axially—in which position it actuates the switch 4 to close the primary circuit of the transformer and provide high-voltage energisation of the ignition element 11—and then rotated to control the gas input to the burner, such gas igniting on contact with the sparks produced by the ignition element 11. Once the gas has ignited, the knob, which remains in the rotated position, is released and pushed axially forward again by the action of a return spring, to free the switch 4 which opens the ignition circuit.

It will be seen that in the drawings the connection means 6 are disposed at locations which simplify the illustration and facilitate the reading of the drawings; in practice, these means can be provided at any place on the units 3 which is technically most advantageous, e.g. near the front surface of the units 3 if it is required to secure free intermediate sections of the power supply line mechanically (e.g. by stapling) to the front surface of the panel 12.

It will be apparent and clear from the foregoing that the invention is in no way limited to those embodiments which have been considered more particularly, on the contrary, it covers all variants.

I claim:

1. An electrical harness for wiring the electrical ignition circuit of a cooking appliance equipped with a plurality of gas burners (10) each provided with a remote-controlled controlled electrical ignition element (11), characterised in that it comprises:

a low-voltage electrical power supply line (1), one of the ends of which is provided with respective terminals (2) for its electrical connection to a low-voltage electrical power supply, a plurality of high-voltage generating units (3), the number thereof being equal to the number of gas burners (10), and being electrically connected to the said power supply line, each unit (3) comprising a switch (4) to control the power supply and being provided with means (5) for fast mechanical connection for connecting the same to a gas tap body (9) controlling the supply of gas to the respective burner, mechanical connecting means (6) for mechanically connecting each of the high-voltage generating units to the electrical power supply line, and respective high voltage output lines (7) from the high-voltage generating units, the free ends of said lines being provided with a terminal (8) for connection to the respective ignition element.

2. A harness according to claim 1, characterised in that it also comprises gas taps (9) mechanically connected, more parcicularly by snap action, to the respective high-voltage generator units (3).

3. A harness according to claim 2, characterised in that the gas taps (9) are mechanically connected to the respective high-voltage generator units in such manner that the switch (4) is so controlled as to be closed by an axial actuation a of knob of a (13) of the gas tap (9).

4. A harness according to claim 1, characterised in that the means (6) for fast mechanical connection of each high-voltage generator unit (3) to the power supply line are adapted simultaneously to form the electrical connection means between said unit and said line.

5. A harness according to claim 1, characterised in that the means for electrically connecting each high-voltage generator unit to the power supply line are adapted automatically to perforate an insulating sheath or sheaths protecting the line.

6. A cooking appliance provided with a plurality of gas burners each provided with a remote-controlled electrical ignition element, characterised in that it is equipped with an electrical harness connected to the electrical ignition elements, such harness being arranged according to claim 1.

* * * * *